US008690804B2

(12) United States Patent
Nilsson et al.

(10) Patent No.: US 8,690,804 B2
(45) Date of Patent: Apr. 8, 2014

(54) CPR APPARATUS AND METHOD

(75) Inventors: Anders Nilsson, Åkarp (SE); Anders Jeppson, Lund (SE)

(73) Assignee: Physio-Control, Inc., Redmond, WA (US)

( * ) Notice: Subject to any disclaimer, the term of this patent is extended or adjusted under 35 U.S.C. 154(b) by 1321 days.

(21) Appl. No.: 12/442,820

(22) PCT Filed: Jan. 14, 2009

(86) PCT No.: PCT/SE2009/000008

§ 371 (c)(1),
(2), (4) Date: Mar. 25, 2009

(87) PCT Pub. No.: WO2009/136831

PCT Pub. Date: Nov. 12, 2009

(65) Prior Publication Data

US 2010/0185127 A1 Jul. 22, 2010

(30) Foreign Application Priority Data

May 7, 2008 (SE) ..... 0801011

(51) Int. Cl.
*A61H 31/00* (2006.01)

(52) U.S. Cl.
USPC ..... 601/41; 601/43

(58) Field of Classification Search
USPC ..... 601/41–43, 44, 49, 51, 97, 100–101, 601/116
See application file for complete search history.

(56) References Cited

U.S. PATENT DOCUMENTS 3,060,925 A * 10/1962 Honsaker et al. ..... 601/24
3,451,072 A * 6/1969 Cogdell ..... 5/109
4,004,579 A * 1/1977 Dedo ..... 601/41
5,327,887 A 7/1994 Nowakowski (Continued)

FOREIGN PATENT DOCUMENTS

EP 1854444 A1 11/2007
EP 1913923 A1 4/2008
WO WO 2004/066901 A1 8/2004

OTHER PUBLICATIONS

International-Type Search Report issued in corresponding Swedish parent Application No. 0801011-8, dated Nov. 14, 2008.

(Continued)

*Primary Examiner* — Patricia Bianco
*Assistant Examiner* — Kari Petrik
(74) *Attorney, Agent, or Firm* — Marger Johnson & McCollom PC

(57) ABSTRACT

A CPR apparatus includes a chest compression unit and a means for mounting the chest compression unit on a patient. The chest compression unit includes a plunger disposed in a housing. At its one end extending from the housing, the plunger has a compression member. The plunger is driven in a reciprocating manner by a reversible electromotor via a mechanical device for translating rotational motion of the motor to linear motion of the plunger or the plunger is driven by a linear induction electromotor. An electromotor control unit including a microprocessor, a first monitor for monitoring the position of the plunger in respect of the housing and a second monitor for monitoring the position of the plunger in respect of the mechanical device for translating rotational motion to linear motion or the rotor of the linear induction electromotor. The monitored positions are communicated to the electromotor control unit. Also disclosed is a corresponding CPR method.

2 Claims, 10 Drawing Sheets

(56) References Cited

U.S. PATENT DOCUMENTS

| | | | | |
|---|---|---|---|---|
| 6,155,257 | A * | 12/2000 | Lurie et al. | 128/204.23 |
| 6,397,843 | B1 * | 6/2002 | Tien-Tsai | 128/204.18 |
| 2001/0011159 | A1 | 8/2001 | Cantrell et al. | |
| 2005/0027238 | A1 * | 2/2005 | Fago et al. | 604/67 |
| 2006/0270956 | A1 * | 11/2006 | Wong et al. | 601/108 |
| 2008/0092677 | A1 | 4/2008 | Tjolsen et al. | 74/23 |

OTHER PUBLICATIONS

Notification of the International Application Number and of the International Filing Date, dated Jan. 15, 2009.

* cited by examiner 32
13
14
30
15
16
17
3
33
5
6
18
19
4
23
22
O1
o
O2
P1
P2
p
M1
M2
m
L1
L2
l

CPR APPARATUS AND METHOD

CROSS REFERENCE TO RELATED APPLICATION

The present application is a 35 U.S.C. §§371 national phase conversion of PCT/SE2009/000008, filed Jan. 14, 2009, which claims priority of Swedish Application No. 0801011-8, filed May 7, 2008, the disclosure of which is incorporated by reference herein. The PCT International Application was published in the English language.

FIELD OF THE INVENTION

The present invention relates to an apparatus and a method for cardiopulmonary resuscitation (CPR).

BACKGROUND OF THE INVENTION

CPR apparatus of various kind are known in the art. One such apparatus is driven by compressed air or breathing gas (Lucas™; Jolife A B, Lund, Sweden). A particular advantage of this apparatus is its low weight and thus mobility. Another advantage is the resilient nature of compressed air, which makes a gas driven CPR apparatus cause less damage on a patient's chest than an apparatus provided with rigid compression means. The known apparatus can be used as ambulance equipment in life-saving situations. It can be also fed with driving gas from a hospital air line, which is desirable in regard of non-interrupted administration of CPR when the patient is admitted to that hospital.

On the other hand, an easily transportable electricity-driven CPR apparatus would be advantageous in view of the more general availability of electric power. Most if not all electronnotor-driven CPR apparatus known in the art seem however to have been conceived for stationary use rather than for ambulant use. The provision of an easily transportable lightweight electromotor-driven CPR apparatus that is energetically autonomous for extended periods of time, such as 30 min or more, is desirable.

OBJECTS OF THE INVENTION

It is an object of the invention to provide a low-weight autonomous electrically driven CPR apparatus which can be easily transported.

It is another object of the invention to provide such a CPR apparatus that cause minimal harm to the patient.

Still another object of the invention is to provide a CPR apparatus capable of administering compressions to the chest of a patient of a desired compression depth.

Further objects of the invention will become evident from the following summary of the invention, a preferred embodiment illustrated in a drawing, and the appended claims.

SUMMARY OF THE INVENTION

According to the present invention is disclosed a CPR apparatus for administering compressions to the chest of a person in need of cardiopulmonary resuscitation. The compressions are administered about perpendicularly to the sternum region of the person in a supine position. The CPR apparatus of the invention comprises an electromotor and a plunger. The plunger, which has the general form of a tube or of which at least a proximal end portion has the general form of a tube, is disposed in a plunger housing. The reciprocating plunger is driven by the electromotor. A compression member is attached to the proximal end of the plunger. The compression member is designed for disposition on the chest of the person receiving CPR; it has a flat or substantially flat proximal surface for abutment with the patient's chest above the sternum and may be provided with a suction cup on this surface. The person receiving CPR is in a supine or substantially supine position resting on a back plate. The CPR apparatus is supported on the back plate by means of rigid or substantially rigid frame or scaffold, in particular a scaffold comprising two arms extending laterally from the back plate in the direction of the housing at which they are fixed. In this application "proximal" and "distal" relate to the person under cardiopulmonary resuscitation. The proximal end of the plunger thus is the near end in respect of the patient's chest whereas the distal end is the far end. If not otherwise indicated the spatial disposition of the various elements of the CPR apparatus is that of the apparatus mounted for providing CPR treatment to a patient.

In particular, the CPR apparatus of the invention comprises a chest compression unit and a means, such as a frame or scaffold, for mounting the chest compression unit on a patient in need of CPR, the chest compression unit comprising a plunger disposed in a housing and having a compression member at its one end extending from the housing, the plunger being driven in a reciprocating manner by a reversible electromotor via a mechanical means for translating rotational motion to linear motion, the chest compression unit further comprising an electromotor control unit that includes a microprocessor, a first monitoring means for monitoring the position of the plunger in respect of the housing, a second monitoring means for monitoring the position of the plunger in respect of the mechanical means for translating rotational motion to linear motion, said positions monitored by the first and second monitoring means being communicated to the electromotor control unit.

According to a preferred aspect of the invention of particular importance, a first compression spring coil operable by the mechanical means for translating rotational motion to linear motion is disposed between the mechanical means and the plunger.

According to another preferred aspect of the invention the frame or scaffold comprises a base. At least a portion extending from the proximal end of the housing is substantially rotationally symmetric, preferably cylindrical. The housing is fixed at the base, preferably in an opening thereof through which it extends. It is by this base that the chest compression unit is attached to the frame or scaffold. The base, which may be flat or bent, has an extension substantially perpendicular to the rotationally symmetric portion of the housing.

The electromotor is a reversible electromotor, in particular a DC motor. It is operatively associated with the plunger by a mechanical means for translating rotational motion to linear motion. A particularly preferred means of this kind is or comprises a ball screw. The ball screw comprises a shaft and a nut. A preferred length of the ball screw shaft is 12 cm or more, in particular about 15 to 18 cm. The ball screw shaft can be axially connected with the driving shaft of the electromotor so as to dispose the shafts in line, or via gear wheels. Alternatively and preferred is their connection via a belt drive, in particular a V-belt or tooth belt drive; in such case the electromotor and ball screw shafts are provided with toothed pulleys.

According to another preferred aspect of the invention the housing is releaseably fixed at the base, in particular arranged displaceably in respect of the base along an axis of translational movement of the plunger in a manner that it can be fixed to and released from the base at chosen points of displacement. With this arrangement the ball screw can be substantially shorter, such as less than 12 cm, for instance 8 to 10 cm, than in an the non-displaceable arrangement. By this arrangement variations in anatomy between different patients are taken into account. In a released state the compression member of the plunger is placed in the chest of the patient, whereupon the housing is locked against displacement in respect of the base.

The plunger housing has a proximal opening through which extends a proximal terminal portion of the plunger so as to make the compression means disposed outside and proximally of the housing. The distal end of the housing is preferably closed by a top wall. The ball screw shaft is disposed in the plunger housing, preferably except for a short portion extending through the top wall to which it is rotatably fixed by, for instance, a ball or roller bearing or a low friction slide bearing. Its pulley is preferably mounted at or near the distal end of the shaft, in particular distally of the bearing. Proximally of the bearing the ball screw shaft has a substantial extension and passes, via the ball screw nut, into the lumen of a substantially rotationally symmetric nut holder by which the nut is firmly held and, optionally, from there into the lumen of the plunger. The ball screw nut is disposed centered in the nut holder by which it is firmly held to prevent it from rotating. The ball screw nut/holder assembly thus is secured against rotation.

The plunger, the nut holder and the ball screw shaft have a common axis disposed in parallel with the axis of the electromotor drive shaft. The ball screw shaft runs freely in the nut holder lumen. At its proximal end the nut holder has a radially extending flange between the proximal face of which and a distal face of the compression member a first compression coil spring is mounted. A second compression coil spring is mounted between the distal face of the radially extending proximal terminal flange of the nut holder and a proximal face of a radially inwardly extending flange of the plunger disposed at the distal end thereof.

According to a further preferred aspect of the invention the plunger is arranged exchangeable, in particular in a manner to allow it to be exchanged for another plunger by the user.

The plunger/nut holder assembly is disposed axially displaceable in the plunger housing, in which it is centered by first linear bearing means mounted in the housing near its proximal end and second linear bearing means mounted on the holder near its distal end. The first linear bearing means, such as one or more linear ball bearings, are disposed between the inner radial face of the housing and the outer radial face of the plunger with which they are in abutment. The second linear bearing means, such as one or more linear ball bearings, are disposed between an outer radial face of the nut holder and the inner radial face of the housing with which they are in abutment.

The electromotor is operatively connected to an electromotor control unit comprising a means for controlling the number of rotations of the motor shaft, and thereby of the ball screw nut shaft, in a stroke, for instance an encoder comprising a microchip. A linear position detection probe mounted inside of the housing is monitoring the axial position of the plunger; an electrical signal representative of the position of the plunger is fed from the probe to the encoder and used there for fine tuning the displacement of the plunger by the electromotor/ball screw assembly. Alternatively, the signals of Hall sensors mounted with the electromotor indicate the number of rotations of the motor in either direction from a given starting position and thus the proximal/distal displacement of the ball nut.

When the ball screw nut is displaced in a proximal direction the proximal terminal flange of the nut holder acts on the first coil spring means thereby pushing the plunger/compression member in a proximal direction. Since, at the start of CPR, the compression member is placed on the patient's chest in an unloaded state, the displacement of the ball screw nut in a proximal direction results in the patient's chest being compressed. The compression depth for a given displacement of the ball screw nut is controlled depending on the resistance of the patient's chest against compression, which resistance can vary in the course of CPR treatment, and on the characteristics of the first coil spring. In CPR a desirable depth of chest compression is about 45 to 50 mm for the average adult person. For physiological reasons the maximum compression force that the apparatus of the invention is allowed to exert on a patient is set to about 700 N. Typically the first coil spring has a spring constant of from about 80 N/mm to about 130 N/mm, in particular of about 100 N/mm, offering a resistance to compression of from 0 N at the neutral position of the plunger to from 250 N to 600 N, in particular of about 350 N, at maximum compression of the first coil spring, which is preferably mechanically limited to about 5 mm. In routine use the first coil spring is compressed by 3 or 4 mm only, and thus mechanical limitation does not come into play. At a high resistance of the chest to compression, the compression limitation of the first coil spring may however be reached, the remainder of the piston's downward stroke thus no longer being damped by the first coil spring. Typically the second coil spring has a spring constant of from about 0.1 N/mm to about 0.2 N/mm, in particular of about 0.15 N/mm, offering a resistance varying from about 12 N at the neutral position of the plunger to about 18 N at maximum displacement of the plunger; in routine CPR the difference in resistance between these positions should not exceed 13 N. The ratio of the spring constants of the first and second compression spring coils is preferably from 150:1 to 1200:1, in particular about 350:1. It is preferred for the electromotor control unit of the CPR apparatus of the invention to include software for calculating the pressure exerted by the plunger on the patient's chest from the positions monitored by the first and second position monitoring means, the first compression spring coil constant and, optionally, the second compression spring coil constant, and for controlling the displacement of the plunger based on said pressure. The electromotor control unit can include waveform software for modifying the displacement of the plunger over a compression/decompression cycle. Alternatively or additionally, the electromotor control unit can include a data storage means comprising a real time clock for storing data processed by the unit and assigning a time to said data, the data storage means being optionally removable and readable in a computer or similar equipment. The CPR apparatus of the invention may furthermore comprise a safety CPR control unit independent of the electromotor control unit, the safety control unit comprising a microprocessor, a plunger position monitoring probe in electric communication with the microprocessor, a temperature monitoring probe, and optionally an electric audio alarm, the safety CPR control unit being energized by the battery energizing the electromotor or a separate battery, the CPR control unit being capable of reversing the electromotor and stopping it when a temperature or positional limit stored in the microprocessor is exceeded.

According to particularly important aspect of the invention the compression of the chest is controlled so as provide a desired compression depth not a desired compression force.

According to another preferred aspect of the invention the electromotor control unit of the CPR apparatus comprises software for recording the initial chest height unaffected by compression, that is, the distance between the skin area above the sternum on which the compression member is applied and the back plate in a direction perpendicular to a support or back plate on which the patient rests with his or her chest. In a zero compression depth setting mode the plunger with the compression member is displaced downward by the electromotor until the face of the compression member facing the chest of the patient is abutting but not compressing the chest above the sternum. During a further downward movement, such as a movement of a few mm, the compression member experiences an increasing a resistance by the chest tissues against compression. This resistance is detected by a change in the ratio of displacement of the first monitoring means and the second monitoring means. Once such a change is detected the displacement is stopped; for positional fine tuning the plunger/compression member may be retracted for the distance during which it has experienced an increasing resistance. Upon retraction the plunger/compression member is set at the exact zero compression depth. Alternatively setting of the zero compression depth can be controlled manually by the operator. The recorded zero compression depth or initial chest height is stored as a reference in a memory of the electromotor control unit. In particular, it is stored in a permanent memory to allow the battery of the apparatus to be changed without loss of data. To compensate for a variation of chest height between patients the electromotor control unit comprises software for setting the full compression depth to a given fraction of the measured initial chest height. The given fraction may be made vary in a linear or non-linear manner between patients with a large chest and patients with a small chest. By this feature of the invention the patient will receive compressions of a depth appropriate to his or her chest anatomy so as to avoid compressions putting the integrity of the tissues of the chest at risk or compressions of insufficient depth.

According to a further preferred aspect of the invention the electromotor control unit of the CPR apparatus comprises software for a soft start of compressions. A soft start of compressions is a characterized by a continuous linear or non-linear increase from a compression depth of zero mm to a full compression depth, such as a full compression depth of from about 40 to about 45 mm and even to about 50 mm or more for an average adult person. The increase extends over a period of from 3 to 25 compressions, preferably of from 5 to 15 compressions, most preferred of about 10 compressions. It is also preferred that, during the period of increasing compression depth, the time at maximum compression in a compression/decompression cycle is shorter, preferably substantially shorter, such as shorter by 50% or even 65% and up 80% or more, that the corresponding time in a compression/decompression cycle in a period of substantially constant compression depth following the period of increasing compression depth.

In clinical practice a patient to whom the apparatus of the invention is applied may have received prior CPR by other means, in particular manual heart massage. Such prior CPR may have resulted in the chest being damaged. According to still another preferred aspect of the invention, the electromotor control unit comprises software for detecting such prior damage. In a patient with a chest physically uncompromised by prior CPR the incremental increase of resistance per mm during a compression of a few mm, such as 4 or 6 or 8 mm, from zero compression depth will be considerably higher than in a patient with a damaged chest, such as higher by 20 percent or more and even by 50% or more. The software for detecting prior damage comprises data for resistance to chest compression recorded in persons with a physically uncompromised chest. To detect a physical damaged chest in a patient selected for CPR, these data are compared with corresponding data obtained in the patient prior to the start of CPR. If the patient data are out of range for a physically uncompromised chest, the motor control of the apparatus is adapted to take into consideration the damage of the chest, and to provide correspondingly less vigorous compressions.

According to a further advantageous aspect of the invention the electromotor control unit can receive input of other patient data, such as of arterial and/or venous blood pressure, carbon dioxide content and/or oxygen saturation of arterial and/or venous blood, ECG data, EEG data; these patient data can be additionally used for electromotor control. It is also within the ambit of the invention to control or co-ordinate, via the electromotor control unit, the administration of defibrillation pulses with CPR. The software for electromotor control may further comprise instructions for selecting among a number of desired compression/decompression curve forms, compression/decompression frequencies, their adjustment over time, and corresponding data stored in a permanent memory.

Furthermore, the software for electromotor control may further comprise instructions for coordinating CPR with a ventilator used concomitantly with the CPR apparatus of the invention.

According to another preferred aspect of the invention is disclosed a CPR apparatus comprising a chest compression unit and a means, such as a frame or scaffold, for mounting the chest compression unit on a patient in need of CPR, the chest compression unit comprising a plunger disposed in a housing and having a compression member at its one end extending from the housing, the plunger being driven in a reciprocating manner by a reversible linear electromotor comprising a stator affixed to the housing and a rotor enclosing the stator and capable of linear motion, the chest compression unit further comprising an electromotor control unit including a microprocessor, a first monitoring means for monitoring the position of the plunger in respect of the housing, a second monitoring means for monitoring the position of the plunger in respect of the rotor, said positions monitored by the first and second monitoring means being communicated to the electromotor control unit. It is preferred for the chest compression unit to comprise a first compression spring coil operable by the rotor disposed between the rotor and the plunger.

According to the invention is also disclosed a method of cardiopulmonary resuscitation comprising administering to the sternum region of a patient cyclic compressions and decompressions by means of a plunger in a CPR apparatus, wherein the plunger is driven by a reversible electromotor via a mechanical means for translating rotational motion into linear motion such as, for instance, a ball screw, optionally comprising a first compression coil spring means operatively disposed between the ball screw and the plunger. It is preferred to control the electromotor by microprocessor means based on plunger position data, ball screw nut position data and compression coil spring constant data. Preferred the first compression coil spring means for use in the method shares the features of the first coil spring disclosed above. The method of the invention can also comprises a second coil spring means corresponding to the second coil spring described above and sharing the features thereof.

The invention will now be described in more detail by reference to a preferred embodiment thereof illustrated in a rough drawing which is not to scale.

SHORT DESCRIPTION OF THE FIGURES

Figure 11A:
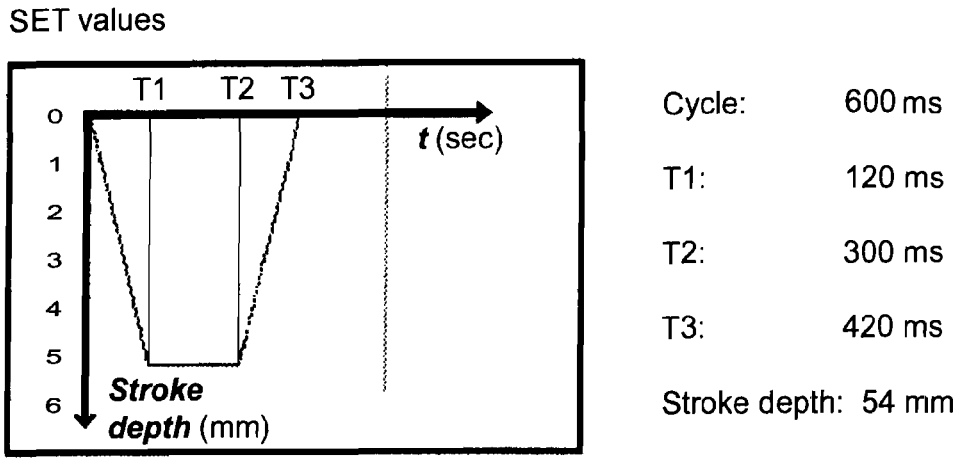
Figure 11C:
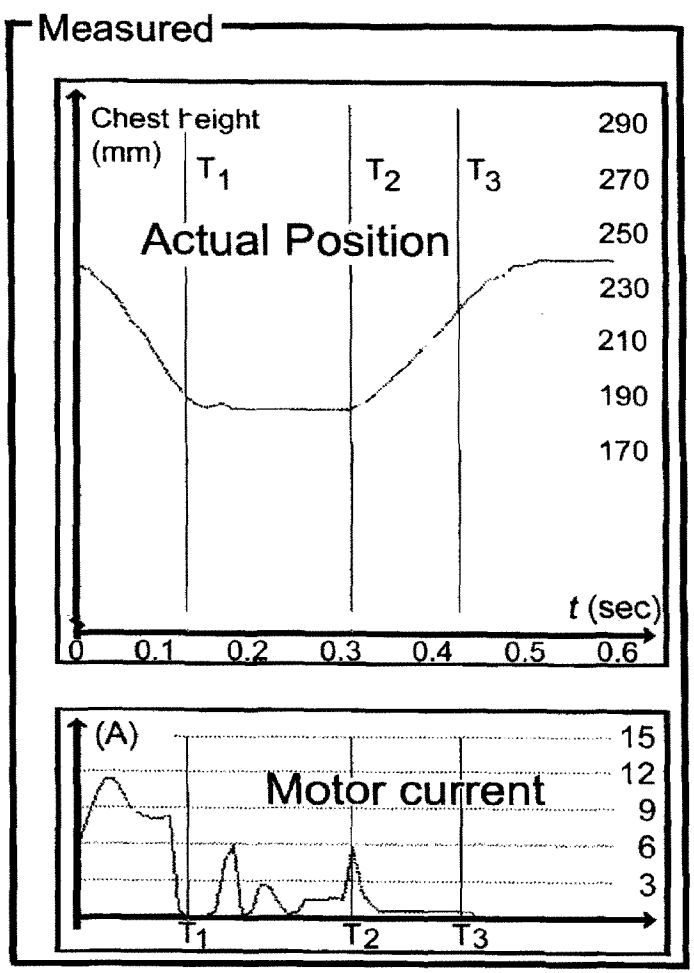
Figure 11B:
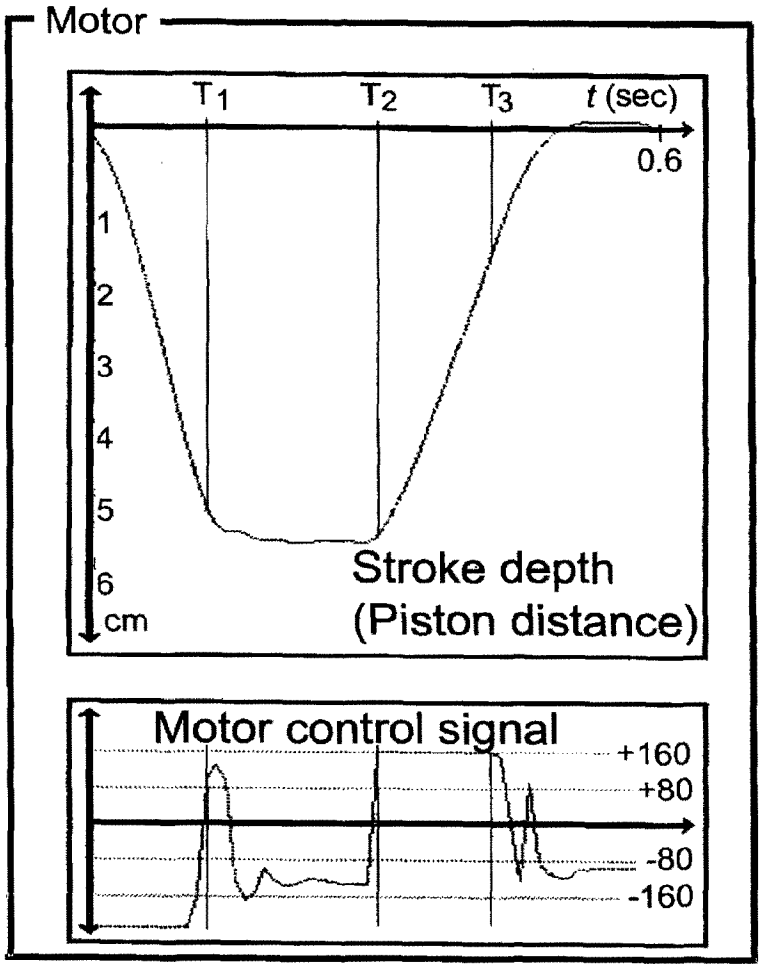

FIG. 11*a* is a diagram illustrating a selected compression/decompression cycle profile generated from a set of entered data;

FIG. 11*b* is a corresponding diagram illustrating the recorded true stroke depth profile and the recorded motor control signal over the cycle of FIG. 11*a;*

FIG. 11*c* is a corresponding diagram illustrating the recorded chest height and the motor current over the cycle of FIG. 11*a;*

Figure 1:
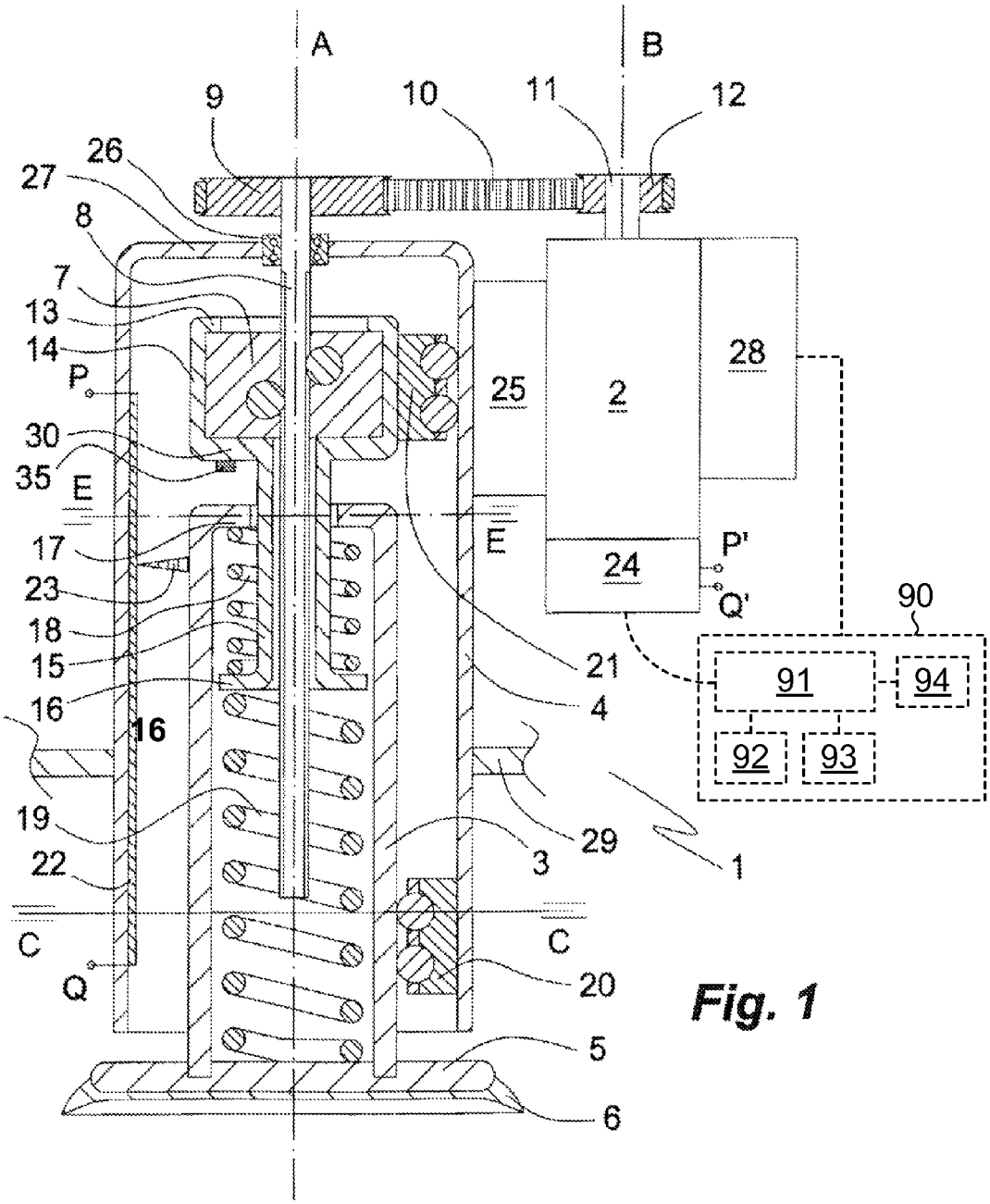
FIG. 1 is a first embodiment of the chest compression unit of the CPR apparatus of the invention, in a sectional view (except for some elements) through the axes A, B of the ball screw and electromotor shafts, with the plunger in a neutral, non-compressing state, the frame not being shown.
Figure 12:
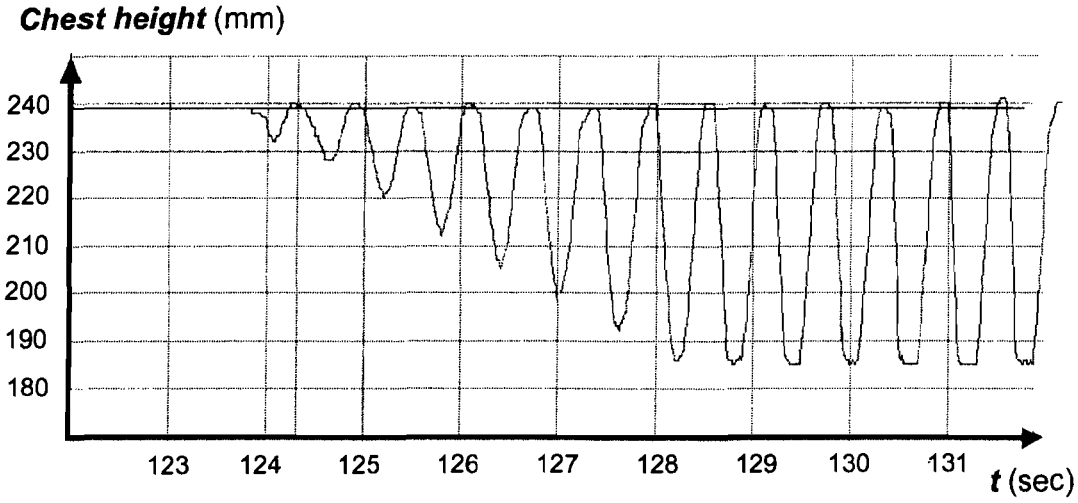
Figure 13:
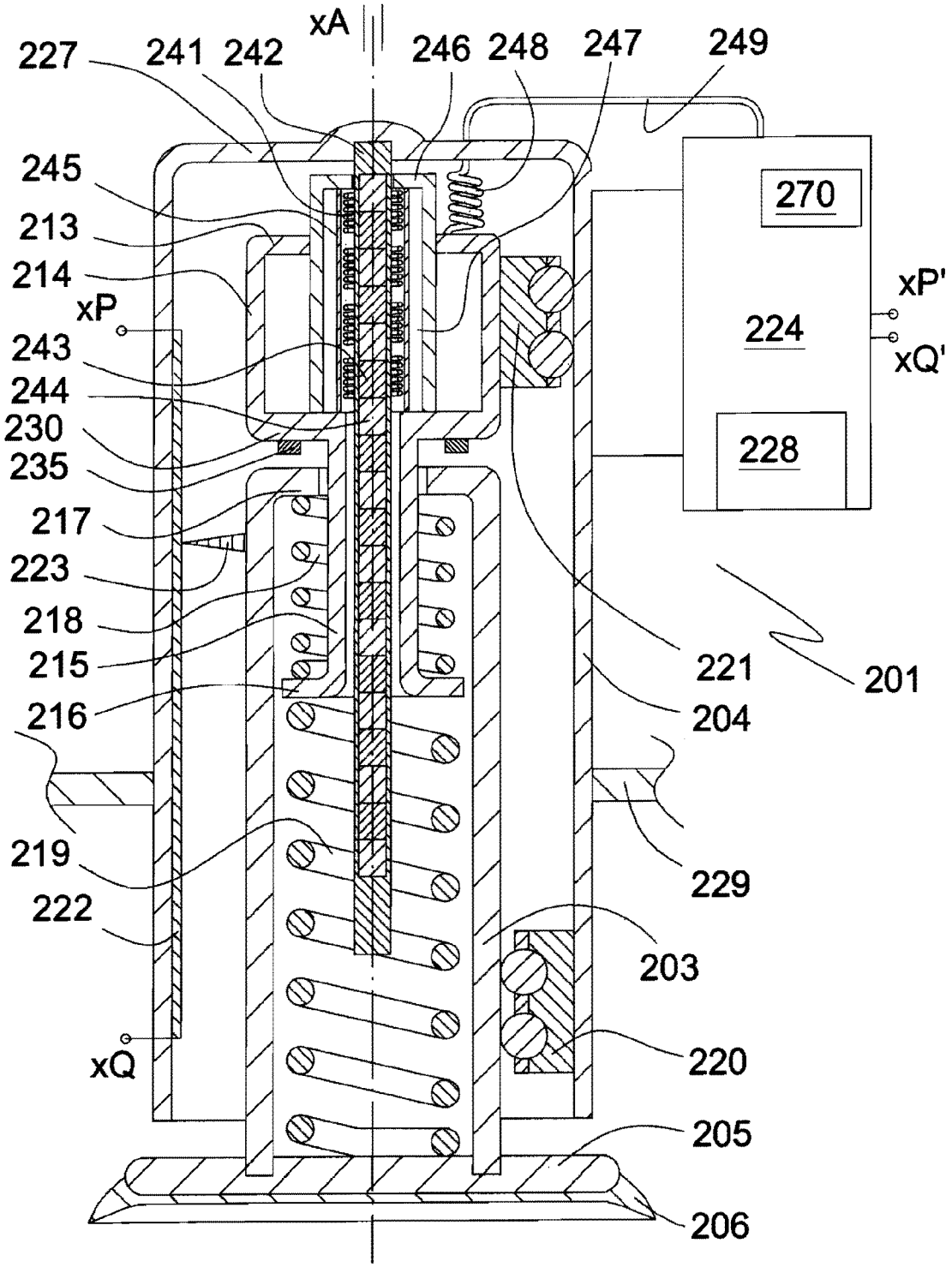

FIG. 12 is a diagram illustrating the profiles over a number of compression/decompression cycles during a soft compression upstart period;

FIG. 13 illustrates a second embodiment of the chest compression unit of the CPR apparatus of the invention, in a sectional view corresponding to that of FIG. 1 except for some elements, with the plunger in a neutral, non-compressing state, the frame not being shown.

DESCRIPTION OF PREFERRED EMBODIMENTS

Figure 2:
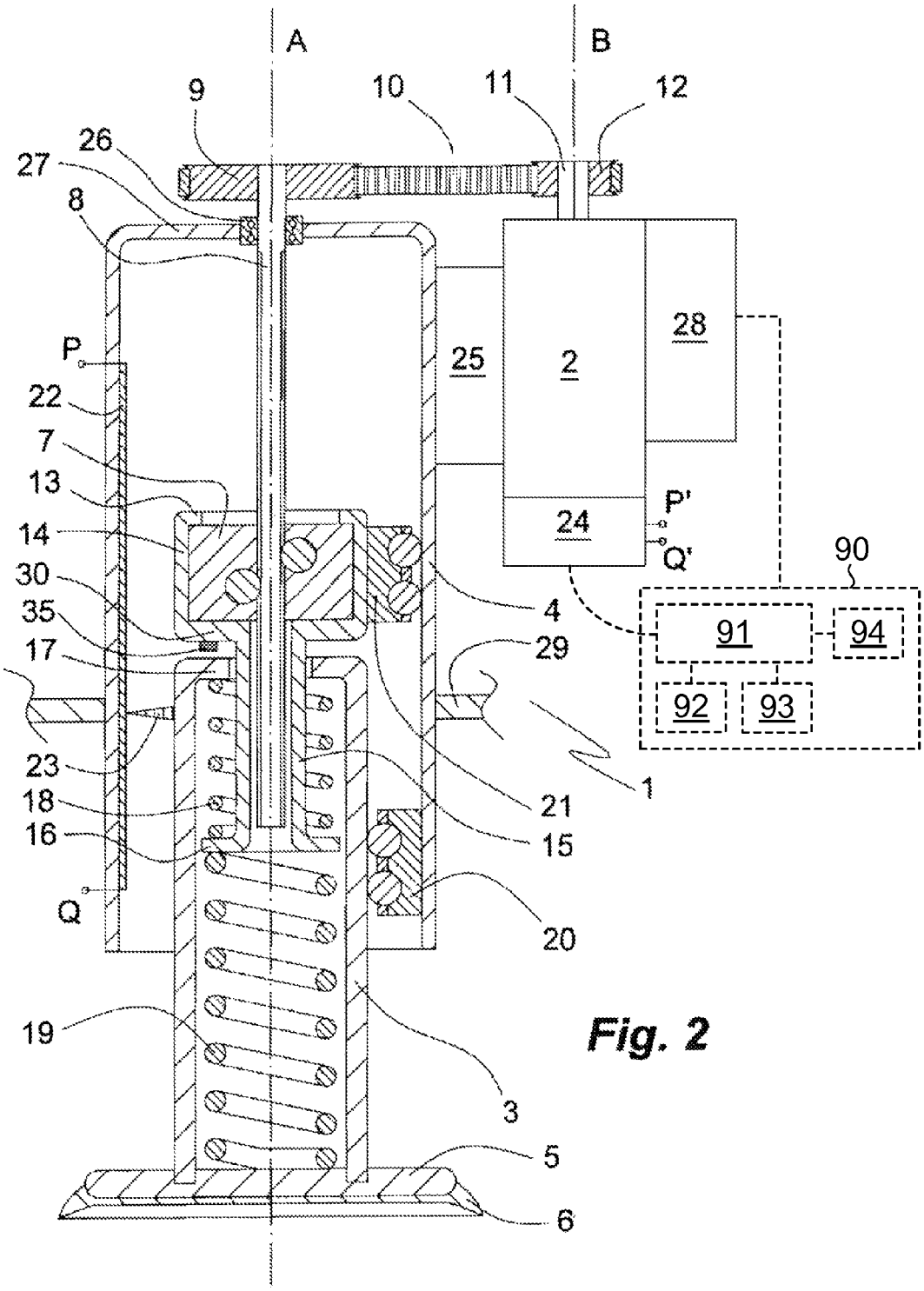
FIG. 2 is the embodiment of FIG. 1, in the same view, with the plunger in an active, compressing state.

The CPR apparatus of the invention comprises a chest compression unit of which a first embodiment is shown in FIGS. 1 and 2. The chest compression unit 1 is mounted in a frame (not shown) and comprises a generally cylindrical plunger 33 (FIG. 4) disposed co-axially in a cylindrical housing 4. The housing 4 has a proximal open end and a distal end closed by a top wall 27. The plunger 33 comprises a cylindrical main section 3 and a distal terminal section in form of an inwardly bent circular flange 17. At its proximal end the cylindrical section 3 of the plunger 33 protrudes from the proximal opening of the housing 4. A chest compression disk 5 provided with a polymer suction cup 6 on its proximal face is affixed to the cylindrical section 3 at the proximal end thereof. From the neutral, unloaded state illustrated in FIG. 1 the plunger 33 can be displaced axially in respect of the housing 4 by ball screw means comprising a ball screw nut 7 mounted on a ball screw shaft 8. The ball screw nut 7 is firmly held by distal wall sections 13, 14, 30 of a generally rotationally symmetric ball screw holder 32. A proximal terminal radial flange 16 of the holder 32 transmits the displacement of the ball screw nut 7 and thus the holder 32 to a distal face of the compression disk 5 by a first spring coil 19 mounted between the distal face of the compression disk 5 and a proximal face of the flange 16. A second spring coil 18 mounted between a proximal face of the nut screw holder's 32 flange 16 and a distal face of the plunger's 33 flange 17 serves for maintaining contact of the first spring coil 19 with the disk 5 and the flange 6. The displacement of the ball screw nut 13 with its holder 32 will now be explained by reference to a shaft 8 with right hand threads. By rotating the shaft 8 clockwise (as seen by a person looking at the shaft from a distal direction) the nut 7 and the holder 32 are displaced in a distal direction; anti-clock-wise rotation causes displacement in the opposite, proximal direction. The distal terminal portion of the holder 32 comprising wall elements 13, 14, 30 is integral with an oblong cylindrical section 15 of smaller outer and inner diameter ending in the aforementioned radially outwardly extending proximal flange 16. The ball screw/nut holder assembly 7, 32 constitutes an actuator that is displaceable along the ball screw shaft 8 and thus along the cylinder axes of the housing 4 and the plunger 33. From a position distally of the housing top wall 27 the ball screw shaft 8 extends through a central opening in the top wall 27 into the housing 4. The ball screw shaft 8 is mounted centrally in the top wall 27 by means of a ball bearing 26. Inside of the housing 4 the ball screw shaft 8 extends via the ball screw nut 7 into the lumen of the nut holder 32 and from there into the lumen of the plunger 33.

Figure 6:
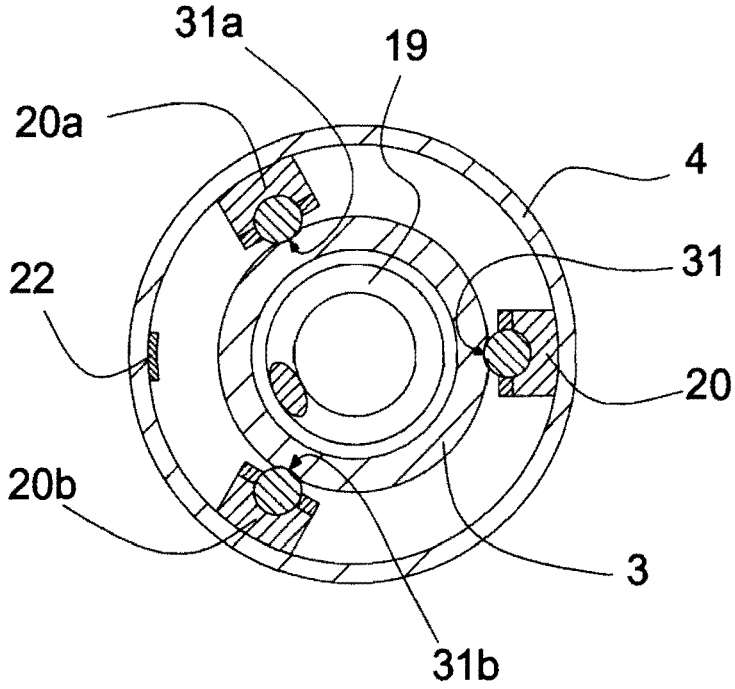
FIG. 6 is a radial section C-C (FIG. 1) through the embodiment of FIGS. 1 and 2.
Figure 7:
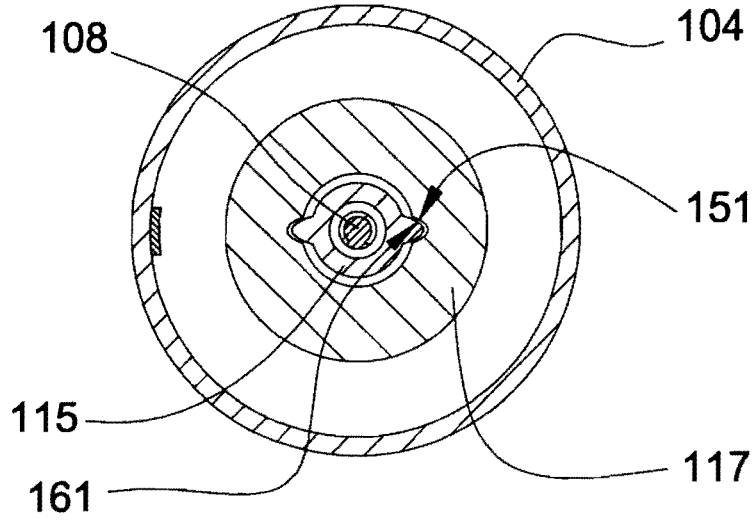
FIG. 7 is a radial section E-E (FIG. 1) through a variant of the embodiment of FIGS. 1 and 2.

The ball screw shaft 8 centers the nut holder 32 and the plunger 33 in the housing 4. In addition, the nut holder 32 and the plunger 33 can be kept centered in the housing 4 by spacer means such as linear ball bearings 20, 21 cooperating with corresponding bearings disposed in corresponding radial planes. This arrangement is shown in FIG. 6 for the plunger 33 centered by ball three bearings 20, 20*a*, 20*b* disposed at angles of 0, 120° and 240° and mounted at the inner cylindrical face of the housing 3. The ball screw nut/holder assembly 7, 32 is secured against rotation in the housing 4 by the balls of the bearings 20, 20*a*, 20*b* running in shallow, axially extending groves 31, 31*a*, 31*b*, respectively, in the outer face of the plunger's 33 cylinder portion 3; alternatively, the locking can be accomplished by slide bearings arranged between the inner cylindrical face of the housing 3 and the outer face of the plunger's 33 cylinder portion or by other suitable means. By a similar arrangement (not shown) the nut holder 32 can be prevented from rotating in the housing 4. It is also possible to lock the nut holder and the plunger to prevent their rotation in respect of each other; this arrangement is illustrated for the combination of a nut holder and a plunger shown in FIG. 7. The oblong cylindrical section 115 of the nut holder has a profile 161 interlocking with a corresponding profile 151 of the distal opening in the plunger's flange 117 section; reference numbers 104 and 108 refer to the cylinder wall of the housing and the ball screw shaft, respectively.

At its end protruding from the top wall 27 of the housing 3 the ball screw shaft 8 carries a toothed pulley 9 cooperating with a toothed belt 10 driven by the pulley 12 mounted on the shaft of a reversible electromotor 2 powered by a rechargeable lithium ion battery 28. The electromotor 2 is firmly mounted at the housing by means of a motor holder 25. Alternatively the electromotor can be mounted on a base 29 at which the housing is mounted. The electromotor is controlled by a control unit 24 comprising microprocessor means. The position of the plunger 3 in respect of the housing 4 is monitored by a position sensor 22, 23 in electrical contact P, Q; P', Q' with the control unit 24.

Displacement of the nut holder 32 in a proximal direction makes the flange 16 act on the proximal end of the first coil spring 19 which transmits the compression force via the plunger 33 to the chest of the patient. The increase of resistance offered against additional compression offered by the chest causes the first coil spring to be increasingly compressed. The arrangement of the first coil spring 19 provides for determination of the force by which the patient's breast is compressed in the following manner. A means 22, 23 for detecting the position of the plunger 33 is arranged between the plunger 33 and the housing 4 in form of a foil potentiometer 22 on which a wiper 23 acts. The foil potentiometer 22 is affixed in an axial direction to the inner face of the housing 4, whereas the wiper 23 is affixed to the outer face of the plunger 33 opposite to the foil potentiometer 22. To bring down wear the wiper can take the form of a spring-loaded ball or a spring-loaded axially rounded wheel. The resistance in the foil potentiometer varies in a linear manner with the position of the wiper 23. The resistance of the potentiometer and thus the position of the plunger 33 is continuously monitored by the control unit. The position of the nut holder 32 and thus the ball screw nut 8 is monitored by the aforementioned control unit. The differences in position correspond to a force that can be calculated by taking into consideration the spring constant of the first coil spring 19, optionally also taking into consideration the spring constant of the second coil spring 18, and be used to adjust the compression depth continuously. A limiter 35 limits the compression of the first coil spring 19.

The CPR apparatus of the invention may furthermore comprise a safety CPR control unit 90 independent of the electromotor control unit, the safety control unit 90 comprising a microprocessor 91, a plunger position monitoring probe 92 in electric communication with the microprocessor 91, a temperature monitoring probe 93, and optionally an electric audio alarm 94, the safety CPR control unit 90 being energized by the battery 28 energizing the electromotor 2 or a separate battery, the CPR control unit 90 being capable of reversing the electromotor 2 and stopping it when a temperature or positional limit stored in the microprocessor 91 is exceeded.

Figures 3, 4, 5:
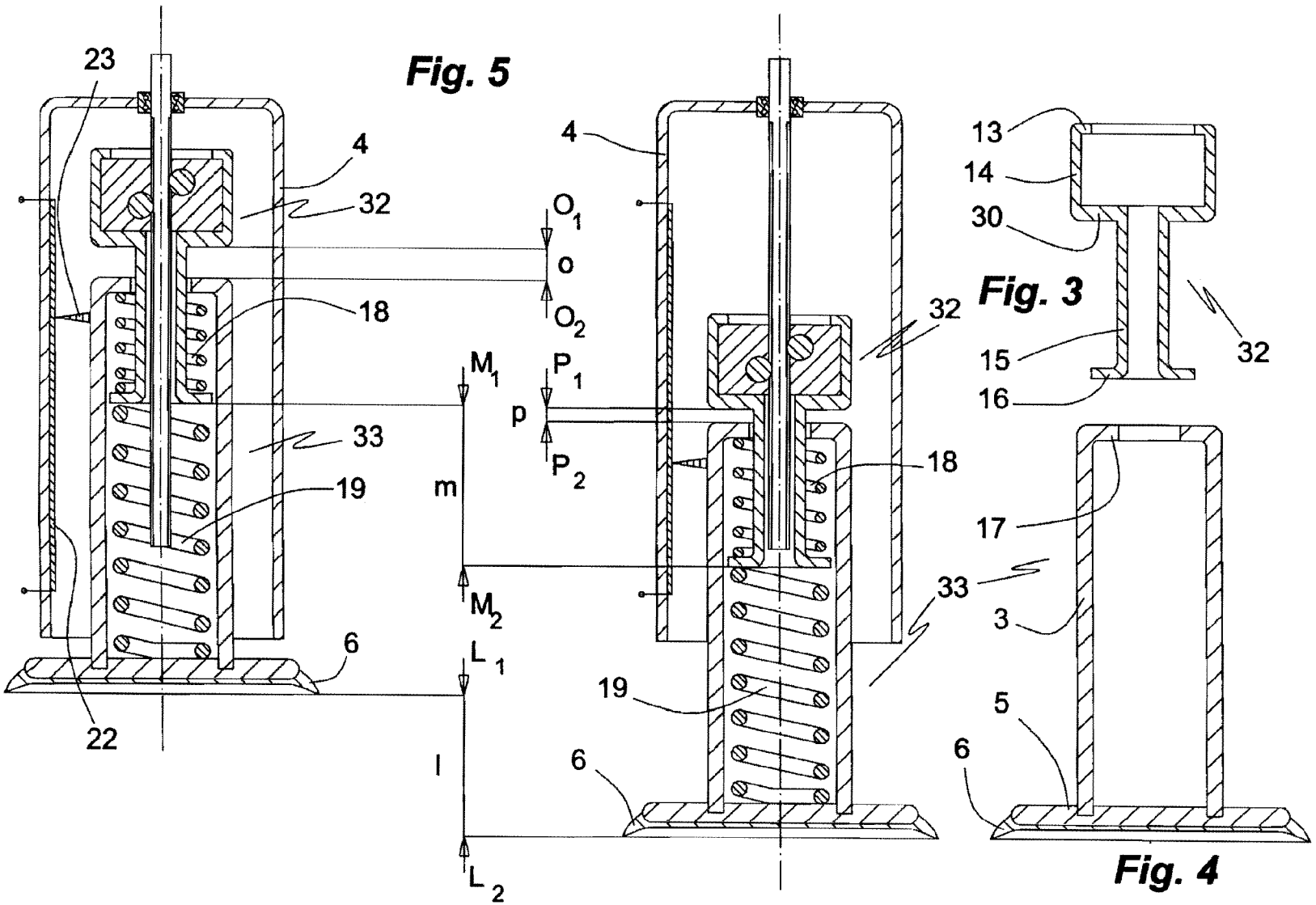
FIG. 3 shows the ball screw nut with its holder of the embodiment of FIGS. 1 and 2, dismounted and in the same view.
FIG. 4 shows the plunger of the embodiment of FIGS. 1 and 2, dismounted and in the same view.
FIG. 5 illustrates the displacement of the plunger and other elements of the embodiment of FIGS. 1 and 2 when moving from the neutral state of FIG. 1 to the compressing state of FIG. 2, in the same view.

The basic operation principles of CPR apparatus of FIGS. 1 and 2 will now be explained in more detail with reference to FIG. 5 in combination with FIGS. 1 and 2. In this figure only elements of the apparatus essential for the explanation are shown. At the left hand the apparatus is shown in the neutral, unloaded state at the start of a compression cycle. At the right hand the apparatus is shown in an active state at end of the compression phase. While the position of the housing is remaining fixed, the plunger 33 and the ball screw nut holder 32 are displaced distally when going from the neutral state to the active state. Prior to administration of compression in CPR the plunger 33 is lowered by making the electromotor 2 rotate the ball screw shaft 8 in an appropriate direction, such as counter-clockwise in case of a shaft 8 with right-handed threads, until the suction cup 6 abuts the chest of the patient at the sternum region. The plunger 33 is now in the neutral or unloaded state, from which the administration of CPR to the patient is started. To allow the plunger 33 be brought into this position merely by rotating the ball screw shaft 8 should have an appropriate length, such as a length of 12 cm or more, preferably of about 15 to 18 cm. Stopping the downward movement of the plunger 33 at the neutral or unloaded state can be controlled by the operator or automated by monitoring the position of the plunger 33 in respect of the nut holder 32 or a corresponding positional relationship. As soon as a decrease in axial distance between them is detected, that is, as soon as for instance a decrease in distance o in FIG. 5 is sensed, the control unit 24 stops the electromotor 2 driving the ball screw shaft 8.

At start the first coil spring 19 is in an extended state whereas the second coil spring 18 is in a compressed state. During compression of the patient's chest proximal face of the plunger's 33 suction cup 6 moves from $L_1$ to $L_2$ over a distance l, whereas the proximal flange face of the ball nut holder 32 moves from $M_1$ to $M_2$ over a distance m. Due to the increasing resistance of the patient's chest against compression met by the plunger 33 its displacement l is smaller than the displacement m of the ball screw nut holder 32, the difference being made up by the compression length of the first coil spring 19, the difference between the distance o between points $O_1$, $O_2$ of the proximal face of the ball screw nut holder 32 and the distal face of the distal terminal face of the plunger 33 and the corresponding distance p between points $P_b$ $P_2$. While the electromotor displaces the ball screw nut holder 32 over a distance m, a compression depth of only l is obtained due to the damping effect of the first coil spring 19, m−l=o−p. Since the displacement l of the plunger 33 is monitored by the linear potentiometric position sensor 22, 23 and the displacement m of the ball screw nut holder 32 is monitored by an encoder or a Hall probe, the compression length o−p of the first coil can be determined. Since the coil spring constant of the first coil spring 19 is known, the compression force exerted on the patient can be determined for any position, and the displacement be controlled by the motor control unit so that a desired compression force is administered to the patient. The first coil spring 19 has a spring constant of about 100 N/mm; it is arranged to be essentially uncompressed in the unloaded, neutral state of the apparatus. The second coil spring 18 has a spring constant of about 0.15 N/mm; it is arranged to be sufficiently compressed in the loaded state to enable it to displace the plunger in a distal direction during the decompression phase. During retraction of the plunger 33 the distance o increases until the plunger 33 does no longer exert a pressure on the patient's chest. At this moment, that is, as soon as the monitoring means detect that the distance o does no longer change, retraction of the plunger 33 is stopped. Since the resilient nature of the human chest and the height of the sternum above the back plate does change, that is, decreases during CPR, it is important that the neutral state of the plunger 33 be adapted to that change to make the plunger 33 always start from a neutral unloaded state. Additionally, the depth of compression, which is appropriately about 50 mm for an adult person, can be varied during CPR, for instance by taking into account the aforementioned anatomical changes monitored by the sensing means of the apparatus of the invention, which can be stored in the memory of the control unit.

Figure 8:
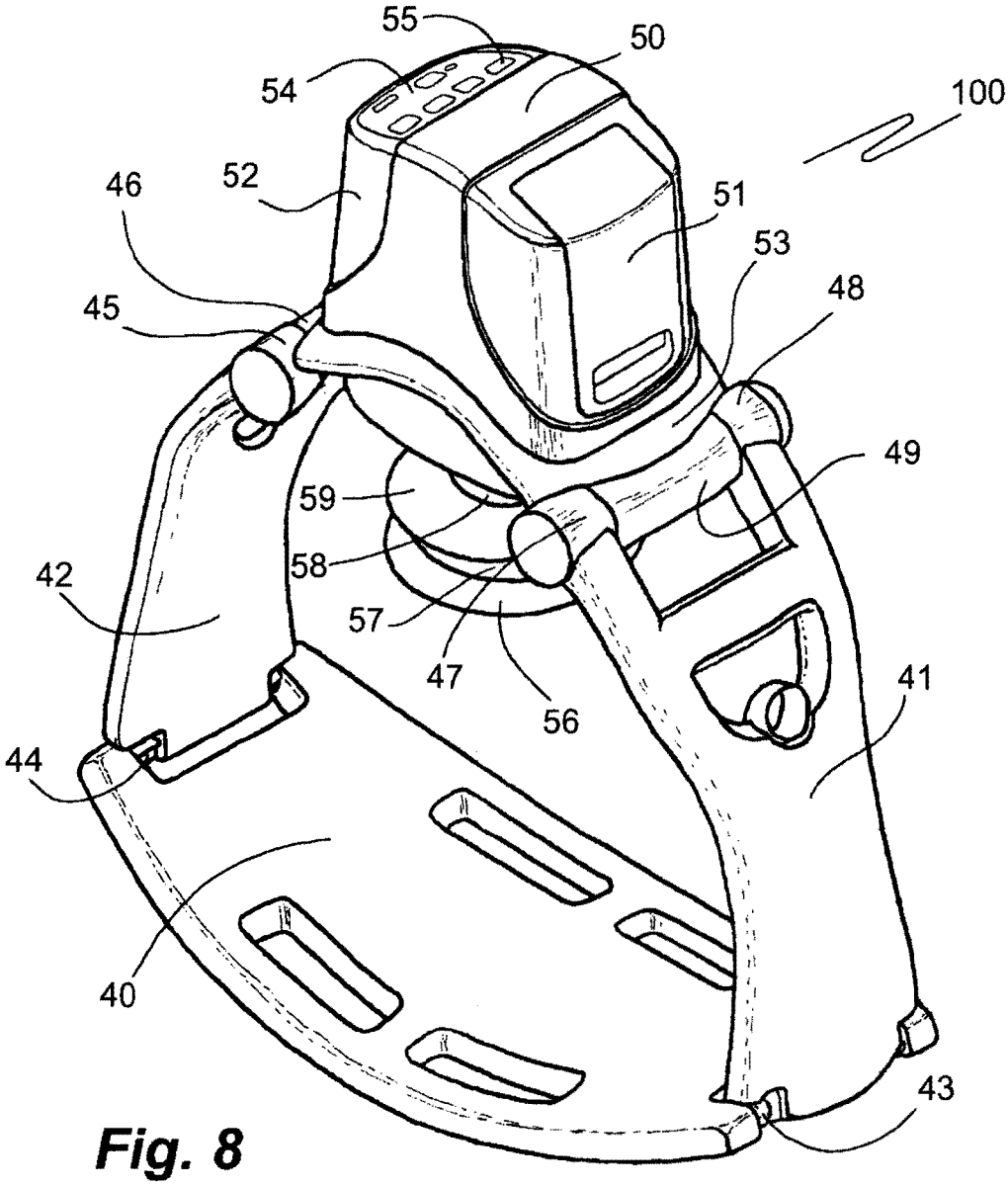
FIG. 8 is perspective view of a first embodiment of the CPR apparatus of the invention.
Figure 9:
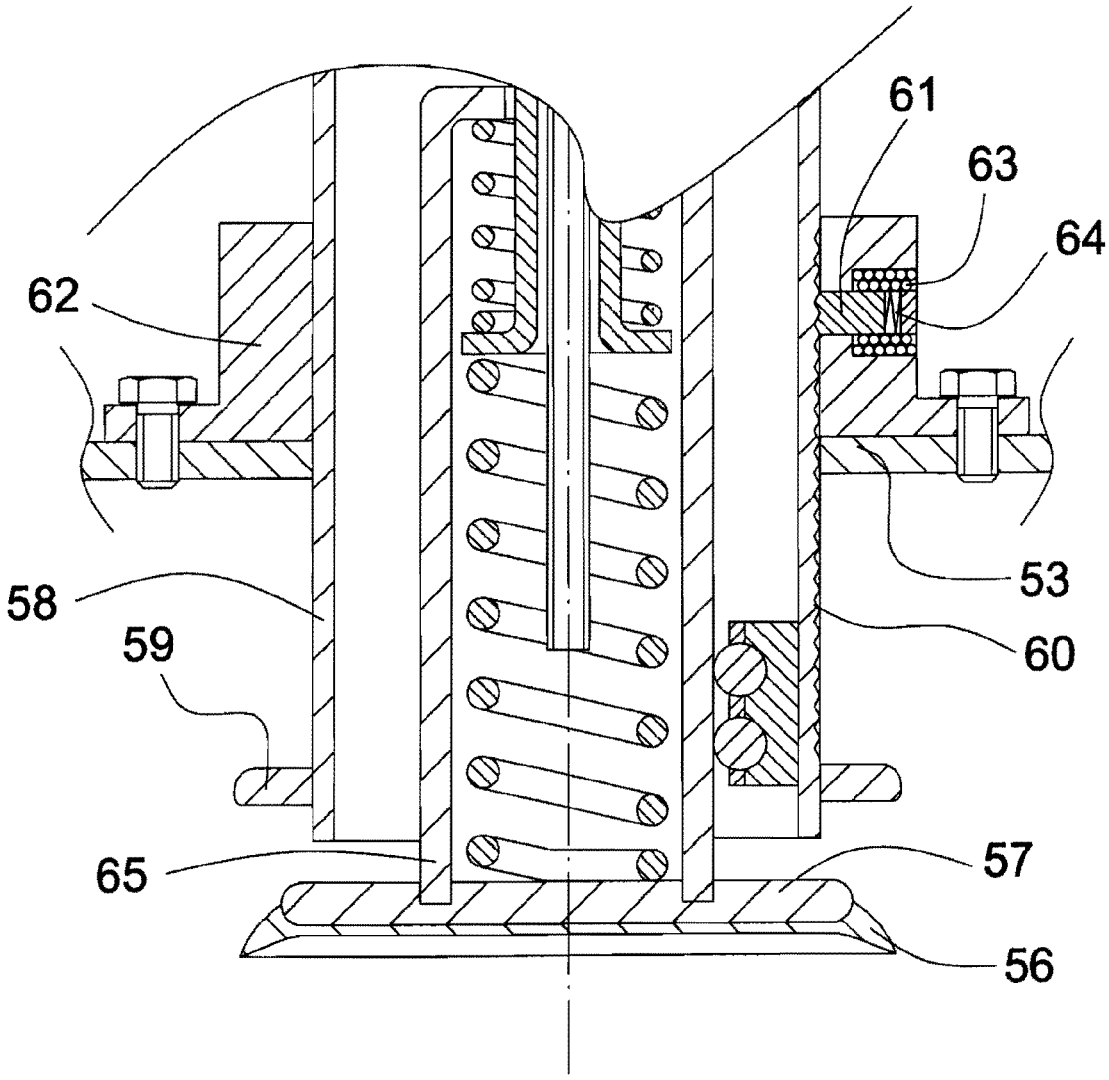
FIG. 9 is a partial sectional view of the chest compression unit of the CPR apparatus of FIG. 8.

FIG. 8 illustrates a preferred embodiment of the apparatus of the invention 100 comprising a chest compression unit attached to a frame. The frame comprises two legs 41, 42 swivelingly (at 43, 44) mounted at opposite ends of a back plate 40. One of the legs 42, alternatively both legs 41, 42, is additionally mounted releaseably (at 44) at the back plate 40 to allow the frame to be easily applied around the chest of a patient. At their other ends the legs 41, 42 are swivelingly mounted by hinges 45; 47, 48 at opposite ends of a base 53 at which the chest compression unit of the apparatus of the invention is mounted. The base 53 forms the uppermost portion of the frame and is positioned at a substantial distance above the chest at the sternum region when mounted to a patient. The compression unit is of similar functional design as the one of FIGS. 1 and 2. The power source 51 and the control unit 52 are however disposed at opposite sides of the housing 58. The housing 58 is mounted at the base 53 in a perpendicular relationship.

In contrast to the rigid mounting of the housing 4 at the base 29 in the embodiment of FIGS. 1 and 2 the housing 58 is mounted at the base 53 displaceably in a manner that it can be locked in a desired axial position. While various locking means are conceivable the locking is accomplished here by an iron cylinder 61 toothed at its one base with which it faces a correspondingly toothed, axially extending face 60 of the housing 58. The cylinder 61 is mounted displaceably in a bore of a sturdy socket 62 enclosing the housing 58 and firmly mounted at the base 53. The bore with the cylinder 61 extends in a direction perpendicular to the cylinder axis of the housing 58. In a locked position the toothed base of the cylinder 61 is pressed against toothed face 60 of the housing 58 by a spring coil. In an unlocked position the iron cylinder 61 is withdrawn against the force of the spring 64 coil from the toothed face 60 of the housing 58 by an energized electromagnet coil 63 into the lumen of which it extends with its non-toothed end. This arrangement allows the housing 58 with the plunger 65 to be displaced in a downward proximal direction towards the chest of the person to receive CPR treatment until contact between the sternum region and the compression disk/suction cup assembly 57, 56 is obtained. Then the housing 58 is locked with the base 53 by energizing the coil 63, and administration of CPR can start. A handle 59 in form of a circumferential flange attached to the housing 58 near its distal end facilitates the axial displacement of the housing 58 in an unlocked state.

The housing 50, the electromotor, the entire transmission of the driving force from the electromotor to the ball nut shaft, and the control unit 24 are partially or fully enclosed by a protective cover 50. The power source 51, a 24 V lithium ion battery, is disposed in a pocket of the cover 50, in which it is held by a snap connection (not shown). An exhausted battery 58 thus can be easily replaced by a charged one. A female connector mounted on the cover 50 allows the motor to be powered by 10-32 V DC, which is available in an ambulance or from a medically certified 90-264 V AC aggregate that provides 24 V DC.

A top face of the control unit 52 is provided with a means for input of instructions to the electromotor control unit. The input means is, for instance, a touch-sensitive polymer film panel 54. The panel 54 comprises a number of input keys 55 and may also comprise indicators, such as LED indicators, for battery status and other functions. By exerting pressure on a particular area an electrical contact is temporarily closed to send an electric signal to the control unit. Since the apparatus of the invention is used in emergency situations, it is important that the operator can rely on a simple choice of instructions.

Figure 10:
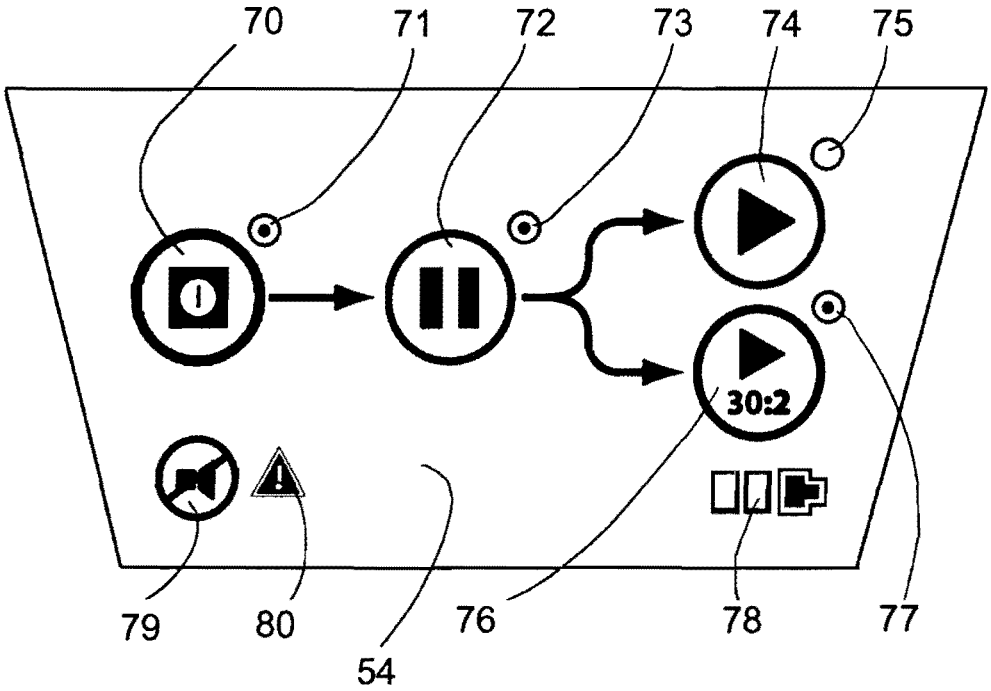
FIG. 10 is a control panel of the chest compression unit of the CPR apparatus of FIG. 8, in a top view.

A panel comprising a polymer foil 54 with touch sensitive areas or buttons 70, 72, 74 76, 79 for entering a preferred pattern of instructions to the apparatus of the invention is shown in FIG. 10. The buttons 70, 72, 74, 76 are paired with LEDs 71, 73, 75, 77, respectively, indicating whether a button has been activated by touching it.

By pressing the adjustment button 70 for a short time (<0.5 seconds) the apparatus is set to a plunger adjustment state. In the plunger adjustment state the position of the plunger with the suction cup in respect of the patient can be adjusted. This adjustment is accomplished by, for instance, means functionally corresponding to the means illustrated in FIG. 8 for locking/unlocking the housing 58 in respect of the base 53. On activating the adjustment state the zero position data in the memory of the control unit is erased. In a plunger adjustment prior to the administration of CPR, the suction cup of the plunger is made to abut the sternum region of the patient's chest without exerting any pressure on it. By pressing the adjustment button 70 for a longer time (>0.5 seconds) the apparatus is switched on or off, depending on its state.

By pressing the locking or pausing button 72 the housing 58 is positionally locked in respect of the base 53. This locking position is stored as the zero (displacement) position in the memory of the control unit. As long as the driving of the plunger is not activated the plunger remains locked with the housing 58. The locking position can be activated during CPR treatment, for instance during defibrillation of the patient or for other reasons.

By pressing the active mode button 74 the apparatus is put into the continuous operating mode, in which it performs continuous compressions at a rate of 100 compressions per minute, which is preferred. The control unit may though be programmed for any other desired continuous compression rate. Alternatively, by pressing the activation 30:2 button the apparatus is put into a discontinuous operating mode, in which it performs 30 compressions at a chosen rate, in particular at a rate of 100 compressions per minute, followed by a pause of 3 seconds in which no compressions are administered. This cycle of 30 compressions/3 sec pause is continued until stopped temporarily by the operator by pressing the pausing button 72 or by pressing the adjustment button 70 to allow the plunger, if desired, to be withdrawn prior to dismounting the chest compression apparatus from the patient.

The charging state of the battery is monitored by light indicators 78. If the battery charge is so low that the battery should be replace the rightmost one of charging state indicators 78 is lighted and a buzzer arranged in the apparatus does emit a buzzing sound. The emptied battery is exchanged for a charged one by pressing the pause button 72, changing the battery, and pressing the active mode button 74 to resume administration of CPR from the stored zero position. The buzzer can be switched off for 60 seconds by pressing the buzzer silencing button 79.

A warning light 80 is set to warn for a variety of malfunctions, such as a software conflict, insufficient battery power, a sensing means failure, etc.

FIG. 11*b* illustrates the motor power supply control signal (by pulse width modulation, PWM) and the recorded compression/decompression profile over a compression/decompression cycle obtained by entering a set of data (length of cycle sec); stroke depth (cm); time (sec) $T_1$ from start of cycle to maximum stroke depth; $T_2-T_1$=time at maximum stroke depth; $T_3-T_2$=time from maximum stroke depth to zero stroke depth) and so as to generate the desired compression/decompression profile illustrated in FIG. 11*a*. FIG. 11 *c* illustrates the motor current (A) and the recorded chest height (mm) over the compression/decompression cycle of FIG. 11*a*.

The electromotor control unit of the CPR apparatus comprises software for recording the initial chest height unaffected by compression, that is, the distance between the skin area above the sternum on which the compression member is applied and the back plate in a direction perpendicular to a support or back plate on which the patient rests with his or her chest. In a zero compression depth setting mode the plunger with the compression member is displaced in a downward direction by the electromotor until the face of the compression member facing the chest of the patient is abutting but not compressing the chest above the sternum. During a further downward movement, such as a movement of a few mm, the compression member experiences an increasing a resistance by the chest tissues against compression. This resistance is detected by a change in the ratio of displacement of the first monitoring means and the second monitoring means. Once such a change is detected the displacement is stopped; for positional fine tuning the plunger/compression member may be retracted for the distance during which it has experienced an increasing resistance. Upon retraction the plunger/compression member is set at the exact zero compression depth. Alternatively setting of the zero compression depth can be controlled manually by the operator. The recorded zero compression depth or initial chest height is stored as a reference in a memory of the electromotor control unit. In particular, it is stored in a permanent memory to allow the battery of the apparatus to be changed without loss of data. To compensate for a variation of chest height between patients the electromotor control unit comprises software for setting the full compression depth to a given fraction of the measured initial chest height. The given fraction may be made vary in a linear or non-linear manner between patients with a large chest and patients with a small chest. By this feature of the invention the patient will receive compressions of a depth appropriate to his or her chest anatomy so as to avoid compressions putting the integrity of the tissues of the chest at risk or compressions of insufficient depth.

In another preferred embodiment of the invention the electromotor control unit of the CPR apparatus comprises software for a soft start of compressions. A soft start of compressions is a characterized by a continuous linear or non-linear increase from a compression depth of zero mm to a full compression depth, such as a full compression depth of 55 mm reached after seven compressions of linearly increasing depth (FIG. 12).

FIG. 13 illustrates a second preferred embodiment of the chest compression unit of the CPR apparatus of the invention, which differs from the first preferred embodiment illustrated in FIGS. 1-5 substantially by the combination of reversible electromotor means and mechanical means for translating rotational motion to linear motion having been exchanged for linear electromotor means. The linear motor means comprise a linear motor of known design, such as one disclosed in U.S. Pat. Nos. 4,460,855 and 5,091,665. Suitable linear motors are manufactured by NTI AB, Spreitenbach, Switzerland and their U.S. subsidiary LinMot, Inc. The chest compression unit 201 is mounted in a frame (not shown) and comprises a generally cylindrical plunger corresponding to the plunger 33 of FIG. 4 disposed co-axially in a cylindrical housing 204. The housing 204 has a proximal open end and a distal end closed by a top wall 227. The plunger comprises a cylindrical main section 203 and a distal terminal section in form of an inwardly bent circular flange 217. At its proximal end the cylindrical section 203 of the plunger protrudes from the proximal opening of the housing 204. A chest compression disk 205 provided with a polymer suction cup 206 on its proximal face is affixed to the cylindrical section 203 at the proximal end thereof. From the neutral, unloaded state illustrated in FIG. 13 the plunger can be displaced axially in respect of the housing 204 by tubular linear induction motor means comprising a "stator" and a "rotor". The stator comprises a longitudinal series of coaxial permanent magnets 243 in, for instance, a NSNS . . . sequence regularly interspaced by a series of non-conducting cylindrical spacers 244 of same diameter. The magnets 243 and the spacers 244 are enclosed in a cylindrical shell 242 of an insulating material. At its one, distal end the stator 242, 243, 244 is centrally mounted in the top wall 227 of the housing 204 in a manner so as to extend along the axis xA-xA of the housing 204 and from there into the lumen of the plunger 233. The rotor comprises a longitudinal series of regularly interspaced cylindrical metal coils 241 centered at the axis xA-xA and enclosing, at a short distance, the stator 242, 243, 244, which is freely axially displaceable within the cylindrical void defined by the coils 241 of the rotor. The rotor, which is referred to in the following by the reference number 241 of the coils is enclosed by a ferromagnetic shielding tube 245. A similarly centered rotor casing 246 surrounds the shielding tube 245 at a distance, the void 247 between the tube 245 and the rotor casing 246 being used for housing electrical circuitry. Electrical connection between the linear motor and a motor control unit 224 is provided by a multi-lead cable 249 comprising an extendable coil portion 248 disposed between the top wall 227 of the housing and the linear motor casing 246 to compensate for axial displacement of the rotor 241. Not shown are Hall sensor or photocell means disposed between the stator and the rotor for detecting their relative position. The rotor casing 246 and, thereby, the rotor 241 is secured at wall sections 213, 230 of a generally rotationally rotor holder 213, 214, 230 functionally corresponding to the ball nut screw holder 32 of the embodiment of FIGS. 1-5. A proximal terminal radial flange 216 of the rotor holder transmits the axial displacement of the rotor 241 to a distal face of the compression disk 205 via a first spring coil 219 mounted between the distal face of the compression disk 205 and a proximal face of the flange 216. A second spring coil 218 mounted between a proximal face of the rotor holder's flange 216 and a distal face of the plunger's 233 proximal flange 217 serves for maintaining contact of the first spring coil 219 with the disk 205 and the terminal flange 216. Appropriate, including alternate, energizing of one or more of the rotor coils 241 displaces of the rotor 241 in a distal direction. Opposite energizing displaces the rotor 241 in an opposite, proximal direction. Wall section 230 is integral with an oblong cylindrical section 215 of smaller outer and inner diameter ending in the radially outwardly extending proximal flange 216. The rotor holder 213, 214, 230 constitutes an actuator, which is displaceable along the stator 242, 243, 245 in either direction by appropriate energizing and thus along the coincident cylinder axes xA-xA of the housing 204 and the plunger 203, 217.

The stator 242, 243, 244 centers the rotor 241 and the plunger 203, 217 in the housing 204. In addition, the rotor 241 and the plunger 203, 217 can be kept centered in the housing 204 by spacer means such as linear ball bearings 220, 221 co-operating with corresponding bearings disposed in corresponding radial planes. This arrangement corresponds to that shown in FIG. 6 for the first preferred embodiment of the invention.

The linear electromotor is powered by a rechargeable lithium ion battery 228. The linear electromotor is controlled by the control unit 224 comprising microprocessor means. The position of the plunger 203, 217 in respect of the housing 204 is monitored by a position sensor 222, 223 in electrical contact xP, xQ; xP', xQ' with the control unit 224.

Displacement of the rotor 241 in a proximal direction makes the flange 216 act on the proximal end of the first coil spring 219, which transmits the compression force via the plunger 203, 217 to the chest of the patient. The increase of resistance against additional compression offered by the chest causes the first coil spring 219 to be increasingly compressed. The arrangement of the first coil spring 219 provides for determination of the force by which the patient's breast is compressed in the following manner. The aforementioned means 222, 223 for detecting the position of the plunger is arranged between the plunger 203, 217 and the housing 204 in form of a foil potentiometer 222 on which a wiper 223 acts. The foil potentiometer 222 is affixed in an axial direction to the inner face of the housing 204, whereas the wiper 223 is affixed to the outer face of the plunger 203, 217 opposite to the foil potentiometer 222. To bring down wear the wiper 223 can take the form of a spring-loaded ball or a spring-loaded axially rounded wheel. The resistance in the foil potentiometer varies in a linear manner with the position of the wiper 223. The resistance of the potentiometer and thus the position of the plunger 203, 217 is continuously monitored by the control unit. The position of the rotor 241 is monitored by the control unit 224. The differences in position correspond to a force that can be calculated by taking into consideration the spring constant of the first coil spring 219, optionally also taking into consideration the spring constant of the second coil spring 218, and be used to adjust the compression depth continuously. The first and second coil springs fully correspond functionally to the first and second coil springs 19, 18, respectively, of the embodiment of FIGS. 1-5. A stroke limiter 235 limits the compression of the first coil spring 219. An operator interface 270 comprising a keyboard and a display allows an operator to enter parameter values for a selected mode of CPR, and to monitor the CPR procedure based on these values. Reference no. 229 designates a portion of the CPR apparatus frame to which the chest compression unit of FIG. 13 is mounted.

The basic operation principles of the chest compression unit of the CPR apparatus of FIG. 13 correspond to those of the unit of FIGS. 1-5 to which reference is made.

The invention claimed is:

1. A CPR apparatus comprising a chest compression unit, a mounting device for mounting the chest compression unit on a patient, the chest compression unit comprising a housing, a plunger disposed in the housing, a compression member at one end of the plunger and extending from the housing, a reversible electromotor, a mechanical device connected from the motor to the plunger for driving the plunger in a reciprocating manner with respect to the housing and for translating rotational motion of the motor to linear motion of the plunger, an electromotor control unit connected to the motor and including a microprocessor, a first monitor operable for monitoring the position of the plunger in respect of the housing, a second monitor operable for monitoring the position of the plunger in respect of the mechanical device for translating rotational motion to linear motion, the positions monitored by the first and second monitors being communicated to the electromotor control unit, wherein the mechanical device for translating rotational motion to linear motion comprises a ball screw nut mounted on a ball screw shaft driven by the electromotor, wherein the housing comprises a distal end wall through which the ball screw shaft extends, wherein the ball screw shaft portion extending from the housing comprises a pulley, and wherein the pulley is a first toothed belt pulley and a driving shaft of the electromotor comprises a second toothed belt pulley such that rotation of the second toothed belt pulley is transferred to the first toothed belt pulley by a toothed belt.

2. A CPR apparatus comprising a chest compression unit, a mounting device for mounting the chest compression unit on a patient, the chest compression unit comprising a housing, a plunger disposed in the housing, a compression member at one end of the plunger and extending from the housing, a reversible electromotor, a mechanical device connected from the motor to the plunger for driving the plunger in a reciprocating manner with respect to the housing and for translating rotational motion of the motor to linear motion of the plunger, an electromotor control unit connected to the motor and including a microprocessor, a first monitor operable for monitoring the position of the plunger in respect of the housing, a second monitor operable for monitoring the position of the plunger in respect of the mechanical device for translating rotational motion to linear motion, the positions monitored by the first and second monitors being communicated to the electromotor control unit, wherein the mechanical device for translating rotational motion to linear motion comprises a ball screw nut mounted on a ball screw shaft driven by the electromotor, wherein the housing comprises a distal end wall through which the ball screw shaft extends, wherein the ball screw shaft portion extending from the housing comprises a pulley, and wherein the pulley is a first V-belt pulley and a driving shaft of the electromotor comprises a second V-belt pulley such that rotation of the second V-belt pulley is transferred to the first V-belt pulley by a V-belt.

* * * * *

UNITED STATES PATENT AND TRADEMARK OFFICE

CERTIFICATE OF CORRECTION

PATENT NO. : 8,690,804 B2
APPLICATION NO. : 12/442820
DATED : April 8, 2014
INVENTOR(S) : Anders Nilsson et al.

It is certified that error appears in the above-identified patent and that said Letters Patent is hereby corrected as shown below:

In the Specification

Column 1, line 35, "electronnotor-driven" should be replaced with --electromotor-driven--.

Signed and Sealed this
Twelfth Day of August, 2014

Michelle K. Lee

Michelle K. Lee
*Deputy Director of the United States Patent and Trademark Office*